United States Patent [19]

Fisher

[11] Patent Number: 4,649,708

[45] Date of Patent: Mar. 17, 1987

[54] ENGINE SYNCHRONIZER

[76] Inventor: Robert K. Fisher, 3818 Delano St., Silver Spring, Md. 20902

[21] Appl. No.: 853,841

[22] Filed: Apr. 18, 1986

[51] Int. Cl.[4] ..... F01B 21/00

[52] U.S. Cl. ..... 60/700; 60/719

[58] Field of Search ..... 60/700, 701, 702, 719

[56] References Cited

U.S. PATENT DOCUMENTS

| | | | |
|---|---|---|---|
| 2,307,334 | 1/1943 | Peek | 60/700 |
| 3,367,110 | 2/1968 | Leeson, Jr. | 60/702 |
| 3,986,363 | 10/1976 | Beaman et al. | 60/700 |
| 4,435,961 | 3/1984 | Stewart | 60/719 |
| 4,479,357 | 10/1984 | Stewart | 60/719 |

*Primary Examiner*—Allen M. Ostrager

*Attorney, Agent, or Firm*—Mason, Fenwick & Lawrence

[57] ABSTRACT

This invention relates to a modular mechanism and methods for synchronizing the speed of one engine with a reference speed such as another engine particularly as found in boats. A physically limited range of fine tuning is combined with the normal operation of existing manual control over its full range of course adjustment, without interference, by way of an adjustable link coupled non-resiliently in series with the throttle linkage and allowed to slide along a non-circular shaft or key that causes micrometer adjustments in length of the link between the manual control and the throttle when the key is turned. The key can be turned by a differential device or reversible motor responding to continuous or interruptable power related to the engine speeds. The device will not bind and need not be stopped from turning at or between its limits because both ends of the linkage cannot encounter opposing stops simultaneously, the link can slide longitudinally on the key, and the key rotates freely at the limits of adjustments. Phasing is also described.

34 Claims, 18 Drawing Figures

FIG-1
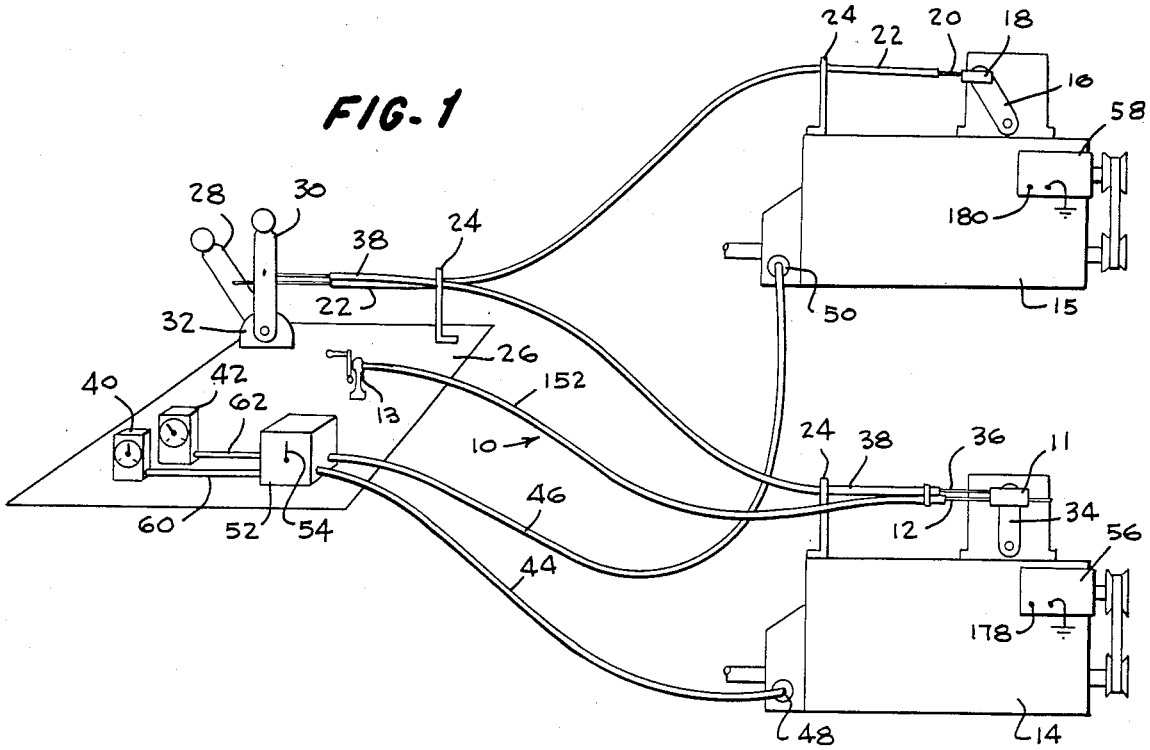
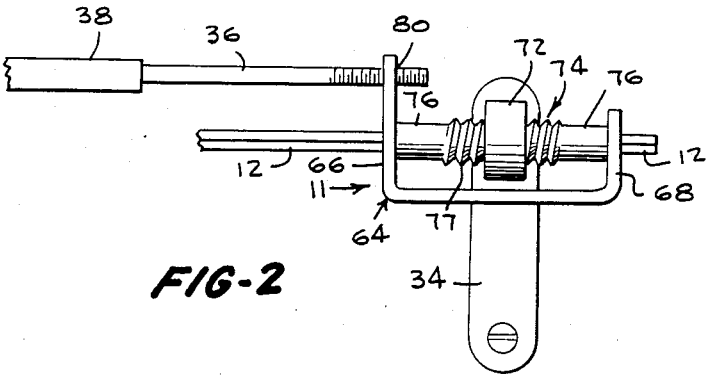
FIG-2
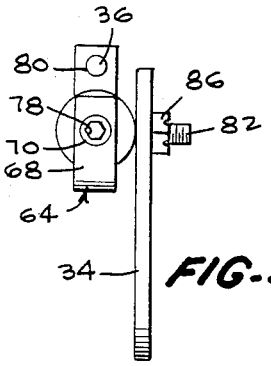
FIG-3
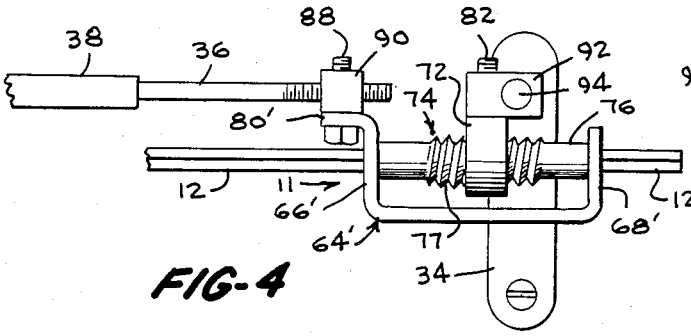
FIG-4
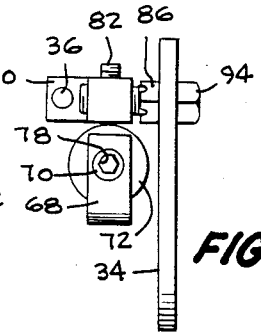
FIG-5

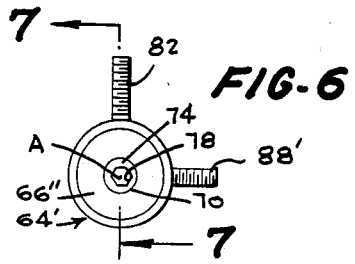
FIG-6
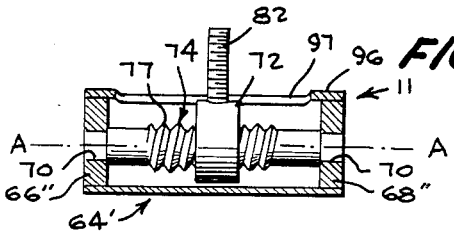
FIG-7
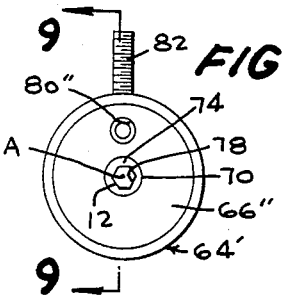
FIG-8
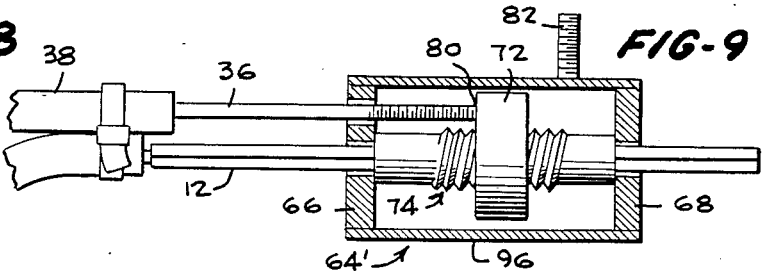
FIG-9
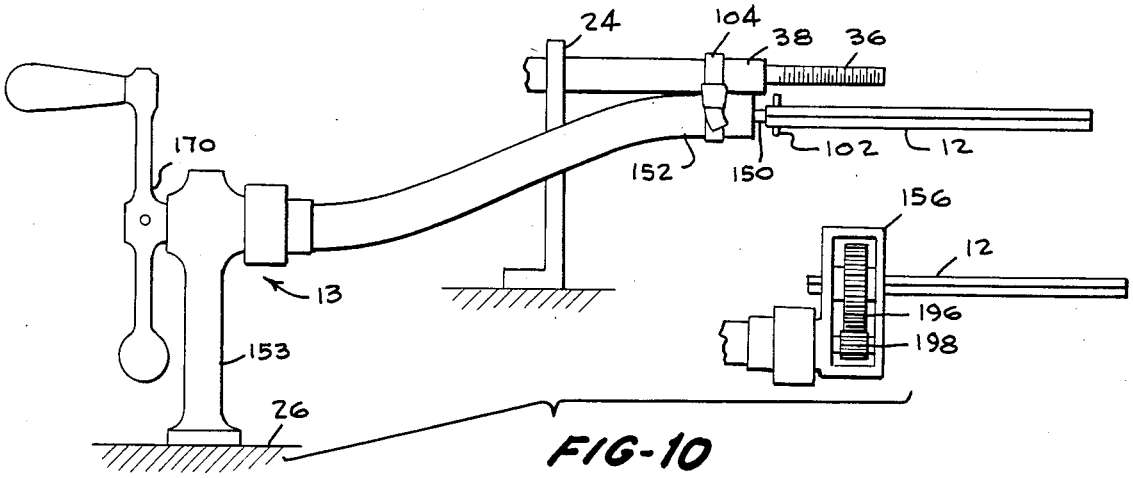
FIG-10
FIG-11
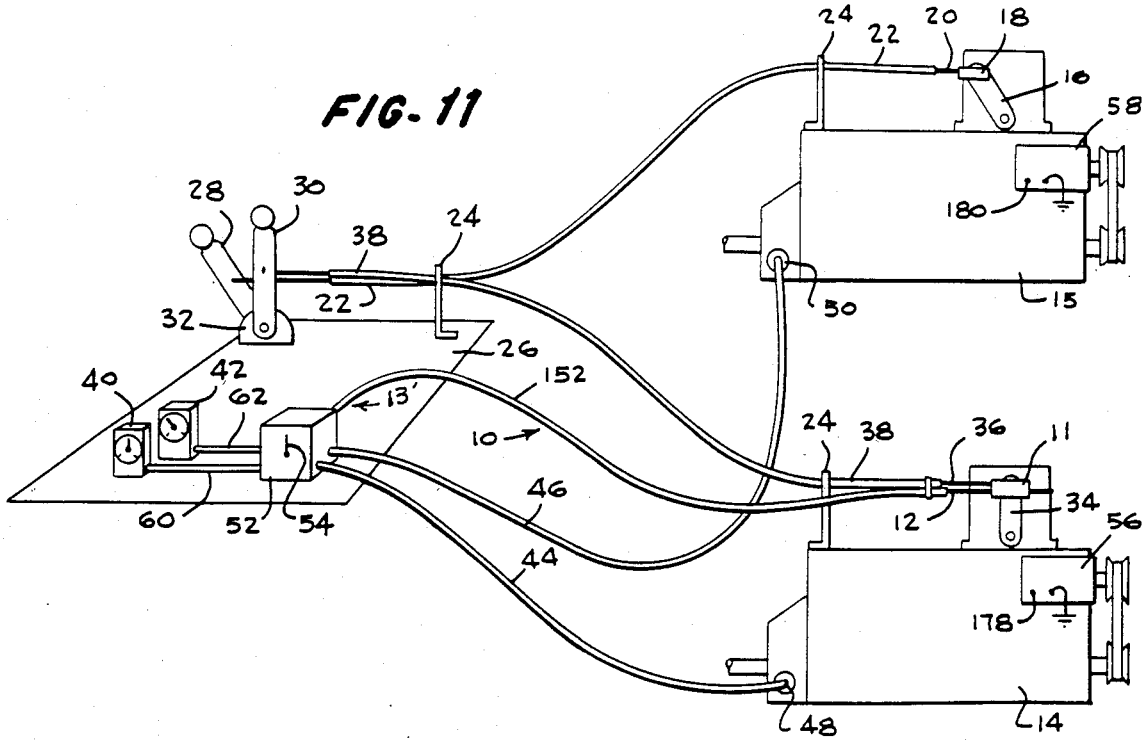

ENGINE SYNCHRONIZER

BACKGROUND OF THE INVENTION

The present invention pertains generally to the control of internal combustion engines where the speed of a first engine is synchronized with some reference speed such as the speed of a second engine, particularly as found in twin engine boats having independent manual throttle controls.

Recently, a number of very accurate electronic synchronization indicators have come on the market with the claim that the operator can synchronize the engines by adjusting the manual controls while observing the indicator. Typically, however, manual controls cause a change in speed of nearly two thousand rpm per inch of travel, are connected to the throttles by long flexible cables (or linkages), and have external springs to reduce lash, so that synchronization by this method is a tedious course-adjustment at best, and the springs tend to urge the vibrating controls away from synchronization once set. An additional apparatus is clearly needed, yet prior apparatus designed to synchronize engine speeds under cruising conditions invariably interfere with the independent manual control needed for certain maneuvers. In panic conditions, the operator may not remember or have enough time to disengage the appratus, reengage linkage members, or lock down moving levers. Therefore, special overriding lever arrangements and resilient couplings were added to these apparatus so that the operator could overpower the apparatus by forcibly holding friction drives and clutches in a slip condition. Invariably this forced slippage wore out the parts and increased maintenance costs. Consequently, other devices to protect the apparatus were added such as solenoids, limit switches, ratchet wheels, etc., which only increased the complexity and production costs, but decreased reliability by their very presence. It is the solution of these problems to which the present invention is directed.

SUMMARY OF THE INVENTION

It is therefore a primary object of the invention to provide speed synchronizing apparatus that overcomes the functional shortcomings of prior apparatus and methods mentioned above.

It is another object of the present invention to provide a speed-synchronizing apparatus of inexpensive modular construction that is reliable, safe to operate, and easily adaptable to a variety of installations without impeding the manual control functions.

It is another object of the invention to provide a speed synchronizing apparatus in combination with a manual throttle control linkage in which minute changes in the throttle position can be made in either direction about the course position determined by the manual control without impeding or limiting the full manual control function, so that the speed synchronizing mechanism need not be rendered inoperative or overridden either forcibly or by way of special lever arrangements in order to operate the engines synchronously at different speeds or asynchronously as often required during maneuvers, especially under panic conditions.

Still another object is to provide a speed-synchronizing apparatus in combination with a manual throttle control linkage which can eliminate the oscillatory speed approximations for which differential gear mechanisms are notorious.

Yet another object is to provide a speed-synchronizing apparatus in combination with a manual throttle control linkage that permits the interfacing mechanism or link to move with the manual linkage without necessarily causing the entire synchronizing mechanism to move, so that certain modules can be non-rotatably mounted on the engine or the linkage, or elsewhere.

Yet still another object is to provide a speed-synchronizing apparatus in combination with a manual throttle linkage having no linear lash, so that counteracting external springs can be eliminated.

Finally, it is an object of the invention to provide a speed-synchronizing and phasing apparatus in combination with a manual throttle linkage that is automatic.

A better understanding of the disclosed embodiments of the invention will be achieved when the accompanying detailed description is considered in conjunction with the appended drawings, in which like reference numerals are used for the same parts as illustrated in the different drawings.

BRIEF DESCRIPTION OF THE DRAWINGS

FIG. 1 is a diagrammatic view of a first embodiment of the present invention employing a remote manual control device in combination with the interactive controls of a twin engine craft.

FIG. 2 is a side elevational view of the linkage and linkage connections shown in FIG. 1.

FIG. 3 is an end elevational view of the linkage connections shown in FIG. 2.

FIG. 4 is a side elevational view of an alternate embodiment of the invention similar to the embodiment of FIG. 2 but having alternate mounting and throttle connections.

FIG. 5 is an end elevational view of the linkage connections shown in FIG. 4.

FIG. 6 is an end elevational view of an alternate embodiment of the adjustable link shown in FIG. 3.

FIG. 7 is a cross-sectional view of the link shown in FIG. 6 taken along line VII—VII of FIG. 6.

FIG. 8 is an end elevational view of an alternate embodiment of the adjustable link shown in FIG. 6 with an alternate cable connection.

FIG. 9 is a cross-sectional view of the link shown in FIG. 8 taken along line IX—IX of FIG. 8.

FIg. 10 is a side elevational view of the remote manual control mechanism for adjusting the link of the embodiment of FIG. 1.

FIG. 11 is a diagrammatic view of a second embodiment of the present invention employing an automatic control device in combination with the interactive controls of a twin engine craft.

DESCRIPTION OF THE PREFERRED EMBODIMENTS

Figure 12:
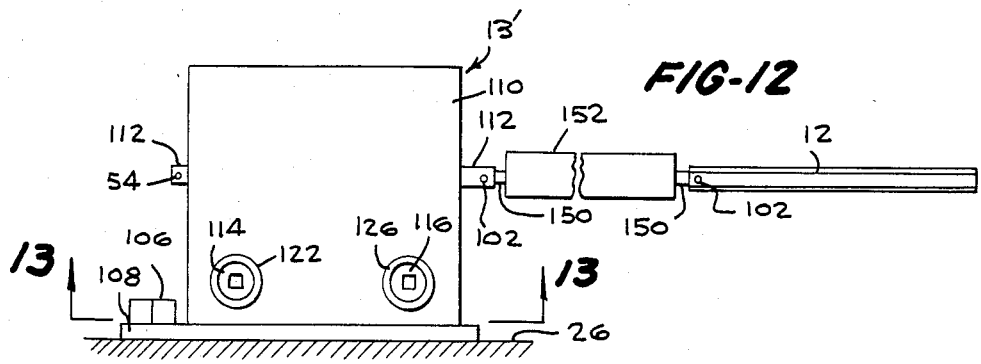
FIG. 12 is a side elevational view of the automatic control mechanism for adjusting the link shown in FIG. 11.

Referring now to FIG. 1, a speed synchronizing apparatus, generally designated as 10, is shown. Speed synchronizing apparatus 10 comprises an adjustable link 11, a non-cylindrical shaft or key 12 rotatably coupled to link 11, and a control device 13 coupled to key 12 for rotating key 12, and is provided on a first engine 14 of a diesel or gasoline powered craft also having a second engine 15. For the purpose of illustration, second engine 15 serves as the pacemaker to which the speed of first engine 14 is to be synchronized, but the choice is purely arbitrary.

The speed of second or pacemaker engine 15 is regulated by the arcing movement of a carburetor throttle or governor control arm 16. Arm 16 is pivotably coupled at one end to a fixed link 18 and is screwed onto a manual control means such as manual control linkage or cable 20 on the other end. Usually, tight spacial restrictions require that throttle 16 be attached to manual control lever 28 by a long flexible cable 20 routed through a jacket 22 attached by stanchions 24 to the engine on one end and to the boat helm 26 on the other. Alternatively, when space is not a restriction, throttle 16 can be rigidly shafted to a manual control lever 28.

Manual control levers 28 and 30 are usually independently movable parts of a common helm control mechanism 32. Levers 28 and 30 are arranged so that both levers 28 and 30 can be moved in unison with one hand, leaving the operator's other hand free to operate the rudder or transmission controls. In fact, since the degree to which fixed link 18 is screwed onto cable 20 determines the overall length of the linkage between control lever 28 and throttle 16, this static adjustment of the overall length allows two such engines to run at roughly the same speed when control levers 28 and 30 are parallel. In practice, however, a tenth of an inch difference either between the control levers or arising from accumulated jacket clearances along the cable length can easily cause a two hundred rpm difference in engine speed, so that further compensation is needed. To this end, a carburetor throttle or governor control arm 34 on engine 14 is attached to adjustable link 11 rather than to fixed link 18. The adjustable link 11 is likewise screwed onto one end of a manual control linkage or cable 36 which slides through a jacket 38. The other end of cable 36 is attached to manual control lever 30 for adjustment of throttle 34 by manual control lever 30, just as throttle 16 is adjusted by control lever 28 so that normal manual control over both engines is retained.

The speed of first and second engines 14 and 15 is measured by electronic or mechanical tachometers 40 and 42, respectively, communicating through respective tachometer sender conduits 44 and 46 with compatible first and second tachometers sender ports or speed transducers 48 and 50 on first and second engines 14 and 15, respectively. A good marine tachometer will have five percent accuracy so that the difference between two such tachometers may be as much as 300 rpm at a midrange speed of 3000 rpm. Hence, a device that accurately responds to the difference in speeds, such as an electronic or mechanical synchronization monitor 52 having an indicator 54, can be placed in communication with the signals sent to each tachometer 40 and 42 from senders 48 and 50 or any other revolving or alternating source such as ignition or charging systems 56 and 58. Additional conduits 60 and 62 are added to reconnect tachometers 40 and 42, respectively, instead of splicing sender conduits 44 and 46.

Referring now to FIGS. 2–7, there are shown alternate embodiments of the modular portion of the speed synchronizing apparatus 10 generally referred to as adjustable link 11. In the embodiments shown in FIGS. 2 and 3, link 11 comprises a substantially U-shaped casing or bracket 64 having parallel, upstanding first and second arms or ends 66 and 68 each having a clearance hole 70 therein, an internally threaded eyebolt or collar 72, a cylindrical tube 74 having an unthreaded portion 76 on each end, an intermediate externally threaded portion 77, and a non-cylindrical internal surface or keyway 78, a cable fastener 80, and a pivotable throttle fastener 82. For the sake of simplicity, cable fastener 80 is shown as a threaded hole in the bracket 64, although it should be understood that such a hole could just as easily be formed in collar 72. Similarly, pivotable throttle fastener 82 is shown as a threaded shaft on internally threaded eyebolt or collar 72, pivotably connected to throttle 34 by a locking nut 86, although such a threaded shaft could be put on bracket 64.

Collar 72 slides over one of unthreaded portions 76 and threads onto threaded portion 77 of tube 74. Tube 74 in turn fits between arms 66 and 68 of bracket 64, so that non-cylindrical shaft or key 12 can slide through clearance holes 70 and keyway 78 to cause rotation of tube 74. When key 12 turns tube 74 with respect to the collar 72, collar 72 moves toward one end of bracket 64 or the other where it can idle on an unthreaded portion 76 and rethread itself upon counter rotation of tube 74.

Since the relative movement between bracket 64 and the collar 72 is linear, adjustable link 11 can be coupled between cable 36 and throttle 34 in any manner similar to fixed link 18, so that throttles 16 and 34 are nearly at the same relative position when control levers 28 and 30 are parallel and collar 72 is midway on tube 74. Then the range of adjustment about the position determined by control lever 30 is equal to one half of the sum of the thread lengths on tube 74 and in collar 72. Link 11 can therefore be quite small.

Fixed link 18 can be of the ball-and-socket type in order to pivotably link cables to throttles that do not lie in parallel planes. As shown in FIGS. 4 and 5, in order to accommodate such installations, a bracket 64′ is used having parallel ends 66′ and 68 and a cable fastener 80′ extending perpendicularly from end 66′. A universal block 90 is coupled to cable fastener 80′ by a bolt 88, and cable 36 is attached to universal block 90. Since bracket 64 can also rotate with respect to tube 74, cable 36 need not be parallel to the plane of the arc of throttle 34 or key 12. Similarly, by interposing a universal block 92 between throttle fastener 82 and throttle 34, key 12 need not be parallel to the plane of the arc of throttle 34. Universal block 92 is coupled to throttle 34 by a bolt 94 secured to throttle 34 by a locking nut 86' (FIG. 5). Thus, contrary to standard practice, adjustable link 11 is capable of being universally coupled on both ends and still able to push and pull throttle 34 without buckling, because it slides along the length of key 12. This feature and the compact size of link 11 make it broadly adaptable to a variety of installations without impeding the manual control function.

Referring now to FIGS 6–9, there are shown two alternate embodiments of adjustable link 11 wherein bracket or casing 64' comprises elongated cylindrical tube 96 having a longitudinal axis A parallel circular end walls 66" and 68". End walls 66" and 68" have central clearance holes 70 concentric with axis A for receiving key 12. As shown in FIG. 7, bracket 64' can also include a longitudinal slot 97 parallel to axis A for receiving throttle fastener 82. As shown in FIGS. 8 and 9, throttle fastener 82 can alternatively be attached to bracket 64' perpendicular to axis A. End walls 66" and 68" preferably are formed by plugs or washers or the like pressed into each end of the tube 96. As shown in FIG. 6, a bolt 88' can be attached to tube 96 perpendicular to axis A for engaging a universal block 90 to cable 36 as shown in FIGS. 4 and 5. Alternatively, as shown in FIG. 8, an aperture 80" can be formed in end wall 66" eccentric to axis A for direct connection of cable 36 to collar 72. Also alternately, a cable fastener (not shown) can be formed in end wall 66" eccentric to axis A for direct connection of end wall 66" to cable 36. The remainaing parts of adjustable link 11 are as previously described with respect to the embodiments shown in FIGS. 2–5.

The central moving part, tube 74, must slidably receive key 12, rotatably bear against end walls 66 and 68, 66' and 68, or 66" and 68", and precisely move collar 72 with low slip-stick friction and little or no lash between any part, and without binding, seizing, or corroding. Operation in a marine environment normally compounds such problems because relatively noncorrosive metals such as aluminum or stainless steel tend to gall, dissimilar bearing metals corrode galvanically, and lubricants collect dirt and grit unless sealed in a closed casing. The present invention resolves these problems by molding or machining tube 74 from a non-metallic no-lubricant bearing material such as nylon, Teflon, or an impregnated polymer. When such a material moves against a metal such as stainless steel, excellent low speed zero-lash bearing surfaces result. Universal blocks 90 and 92 can be similarly molded or machined.

Figure 14:
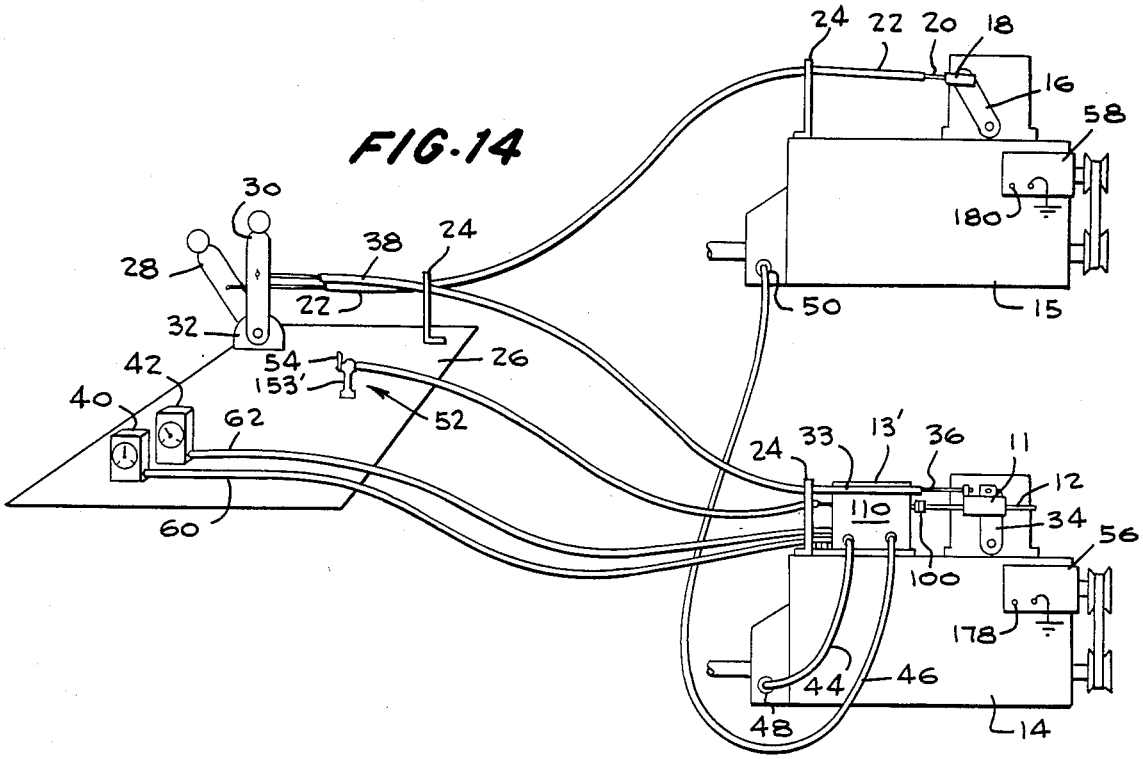
FIG. 14 is a diagrammatic view of a third embodiment of the present invention employing an automatic control device in combination with the interactive controls of a twin engine craft.

Referring now to FIGS. 2, 4, and 10, link 11 is precisely adjusted by turning key 12, which is coupled for reversible rotation to remote manual control device 13 by a direct coupling such as a pin 102, or a pressed fit, weld, etc. (FIGS. 1, 10, and 14). As illustrated in FIGS. 2, 4, and 10, the proper coupling and securing of control device 13 will allow link 11 to slide along key 12 to accommodate any position of throttle arm 34.

Manual control device 13 is the simplest form of control device. Referring now to FIGS. 1 and 10, manual control device 13 comprises a hand crank 170 mounted on a stanchion 153 and coupled to key 12 for reversible rotation by a direct coupling such as a pin 102 (FIG. 10), or other well-known means such as a pressed fit, weld, etc. Manual control device 13 is kept from rotating counter to key 12 by a quick tie 104 secured to cable 36 or jacket 38, or other equivalent, well-known securing means. Only when slow beat-frequency droning cannot be monitored audibly does the manual control device 13 requires use of a separate synchronization monitor 52. Sychronization monitor 52 can be, for example, a differential gearbox 110 coupled to tachometer sender conduits 44 and 46, as described in greater detail hereinafter.

Figure 13:
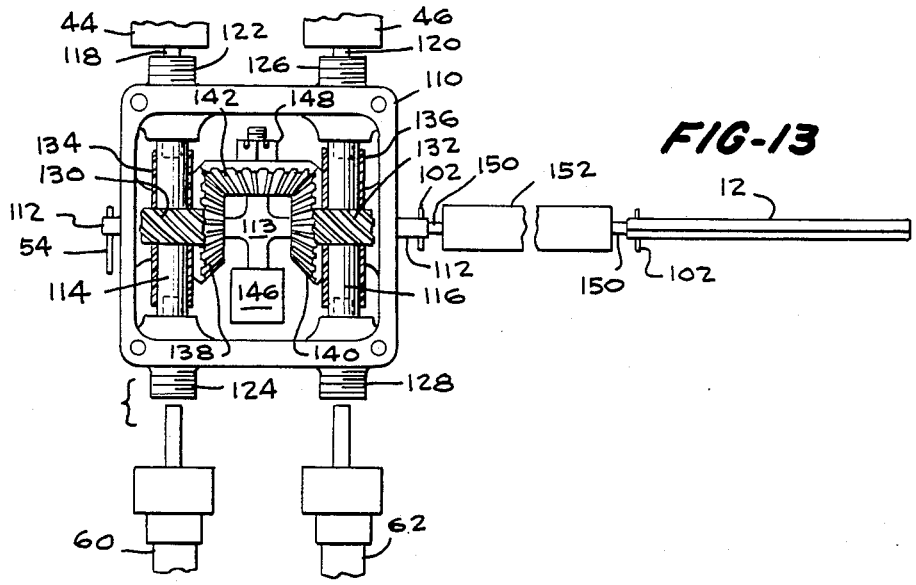
FIG. 13 is a cross-sectional view of the mechanism shown in FIG. 12 taken along line XIII—XIII of FIG. 12.

The classic control device for synchronization is a differential gear. An alternate embodiment of the invention employing a differential gear as the control device 13' is shown in FIG. 11. A differential gear for use as a control device can take any of a number of well-known forms. One such form, an unclutched differential gearbox 110, is shown in FIGS. 12 and 13. Gearbox 110 includes an output shaft 112 extending from opposite sides thereof and having a central spider portion 113. Key 12 is coupled to one end of output shaft 112. Gearbox 110 further includes parallel, spaced apart input shafts 114 and 116 perpendicular to output shaft 112, and four inputs 122, 124, 126, and 128 located at the opposite ends of shaft 114 and 116. Thus, all possible directions in input rotation can be accommodated, even though only one input on each shaft can be chosen for a given installation, leaving the unused inputs to be used as outputs to the tachometers 40 and 42 via conduits 60 and 62, as shown in FIGS. 1 and 11.

Output shaft 112 can be coupled for reversible rotation to key 12 by a universal block 100, as shown in FIG. 14, or by a direct coupling such as a pin 102, as shown in FIG. 13, or a pressed fit weld, or the like. Pinion gears 130 and 132 on shafts 114 and 116, respectively, mesh with reduction gears 134 and 136 positioned between inputs 122 and 124 and between inputs 126 and 128, respectively. Reduction gear 134 and 136 in turn drivingly engage bevel gears 138 and 140, respectively. A bevel gear 142 meshes between bevel gears 138 and 140, and idles on spider portion 113 of output shaft 112. A counterbalance 146 is mounted on spider portion 113 opposite bevel gear 142. Preferably, the ratios of reduction gears 134 and 136 are whole multiples of pinion gears 130 and 132. The lash is adjusted by a locking nut 148 at bevel gear 142. Gearbox 110 is kept from rotating counter to key 12 by a fastener 106 secured to a stanchion or plate 108. When used as a synchronization monitor 52, as shown in FIG. 1, the angular velocity of the output shaft 112 is proportional to the difference in angular velocities of the keyed input shafts 114 and 116 which are adapted to receive the similarly keyed shafts 118 and 120 of conduits 44 and 46 from each engine.

The significant aspect of gearbox 110 as shown in FIG. 13 is the direct interaction between input shafts 114 and 116 and output shaft 112; that is, there are no clutches, friction drives, ratchets, etc. Hence the phase input shafts 114 and 116 is known by the position of shaft 112 relative to the gearbox 110 as indicated by a pin 54 (FIG. 11) mounted on output shaft 112 perpendicular to shaft 112. Thus, the differential gearbox 110 can be used only as a monitor 52 (FIG. 1), or only as a control device when coupled to the key 12 (FIG. 14), or used as both if shaft 112 is coupled with both the helm 26 and the key 12, for example through a rotary cable 150 in a conduit 152 (FIG. 11). Automatic synchronization with manual phasing can be achieved by jogging the helm controls 32 until satisfied or frustrated. When gearbox 110 is used only as a control device, as shown in FIG. 14, a separate synchronization monitor 52 is used, comprising rotary cable 150 in conduit 152, a stanchion 153' for mounting conduit 152, and an indicator 54 coupled to cable 150. However, this monitor is not needed for synchronization without phasing.

Figure 16A:
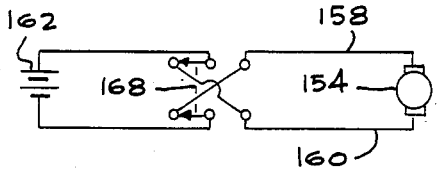
FIG. 16*a* is a schematic diagram of a remote manual control circuit for adjusting the electric motor shown in FIG. 15.
Figure 16B:
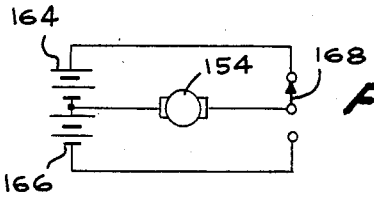
FIG. 16*b* is a schematic diagram of an alternate remote manual control circuit for adjusting the electric motor shown in FIG. 15.
Figure 15:
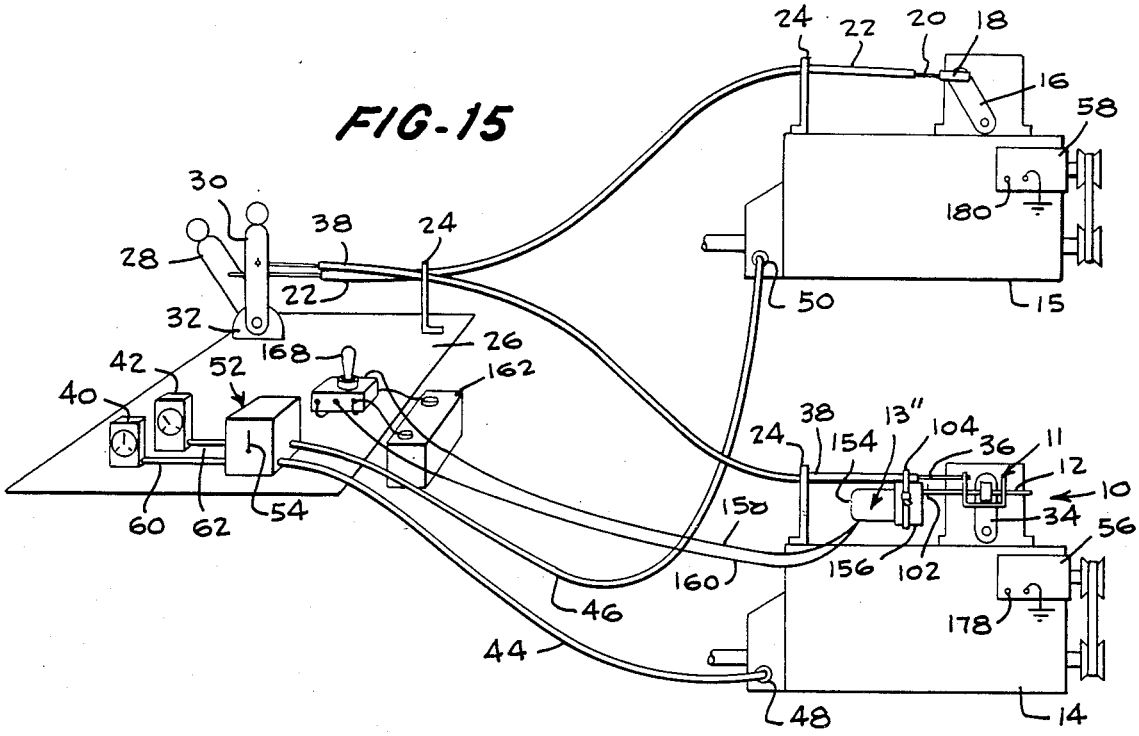
FIG. 15 is a diagrammatic view of a fourth embodiment of the present invention employing an electric type of remote manual control device in combination with the interactive controls of a twin engine craft.

An electric type of remote manual control device 13" is shown in FIGS. 15, 16*a*, and 16*b*, and comprises an electric motor 154 and a reduction gearbox 156. Key 12 is coupled to electric motor 154 either directly or by way of reduction gearbox 156. Motor wires 158 and 160 are connected to motor 154 and to a battery 162 (FIGS. 16 and 16*a*) or split supplies 164 and 166 (FIG. 16*b*) by way of a three position on-off-on switch 168, so as to reverse the current flow through the motor 154 or stop it. This electric type of device has economic advantages over its simplest mechanical counterpart, manual control device 13 (FIGS. 1 and 10), yet still has the functional advantage of being stopped at or near synchronization rather than constantly oscillating about synchronization, as occurs with differential gearboxes 110 and similar continuous automatic apparatus used in prior art apparatus. That is, the response of an engine 14 to a movement of throttle arm 34 is not immediate, yet arm 34 is continuously moved in one direction by such prior apparatus until the speeds are equal, at which time throttle or arm 34 is necessarily overly accelerated or decelerated, as the case may be.

In order to achieve synchronization in prior art apparatus, or at least stable near-synchronization, the movement of arm 34 must be stopped before the speeds are synchronized. An operator with manual control will instinctively do just that by jogging handcrank 170 or switch 168 as he observes indicator 54 approaching the proper synchronization or phase. Another advantage of electric motor 154 is that it offers the opportunity to duplicate the operator's example by electronic and therefore automatic control.

Figure 17:
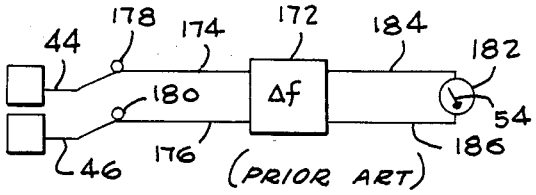
(PRIOR ART) FIG-17
FIG. 17 is a schematic diagram of a typical, commercially available synchronization monitor of the electronic type for use with the embodiment shown in FIG. 15.
Figure 18:
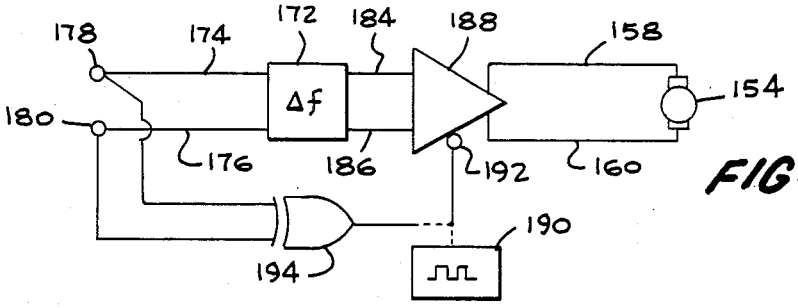
FIG. 18 is a schematic diagram of an automatic control circuit for synchronizing, or synchronizing and phasing, an engine via the electric motor shown in FIG. 15.

A block diagram of a commercially available electronic synchronization monitor 172 is shown in FIG. 17. Here, sensor wires 174 and 176 are electrically tapped into tachometer sender conduits 44 and 46 or otherwise communicate with compatible tachometer sender ports or speed transducers such as outputs 178 and 180 of electric generators 56 and 58, respectively. The degree of synchronization is indicated on a display or meter 182 having electrical connections 184 and 186 between which an electrical difference is produced relative to the difference in engine speeds. A control device which is automatic can be obtained as shown in FIG. 18 by connecting motor wires 158 and 160 to indicator connections 184 and 186 either directly or by way of a differential amplifier or buffer circuit 188. In either case, meter 182 of the apparatus shown in FIG. 17 is now superfluous.

Actually, any electronic device capable of measuring the frequency difference between the input signals that is able to drive motor 154 can serve as an automatic control device for the purpose of synchronization to within a bandwidth of frequencies defined by the electronics. Such a bandwidth, or so called dead-band, is created by the reduced power to motor 154 as the engine speeds approach synchronization. Motor 154 is thus stopped from moving throttle 34 before the engine speeds become equal, and will not start again unless the speeds are different enough to provide the required start-up power to motor 154. The narrowing of bandwidth based on this method alone is limited by the difference between the stall and start-up power of motor 154, the conversion gain (power per unit of frequency difference) of monitor 172 or buffer circuit 188, and the response time of the engines. Since the response time varies from one engine to another, the conversion gain should be peaked for the specific engine in order to minimize the bandwidth. If the gain is too large, than the engine will tend to oscillate in a manner analogous to that of the differential gear driven systems described earlier.

When the engine response time is very long, or for more precise synchronization in general, motor 154 can be operated intermittently or in a so-called pulsed mode by periodically interrupting or otherwise inhibiting the power to motor 154. For example, an oscillator or clock circuit 190 can be connected to an inhibit input 192 on buffer circuit 188. Buffer circuit 188 can then be operated at a very high gain (narrow bandwidth) even with slowly responding engines. The pulse rate and duty cycle of clock circuit 190 can be either fixed or adapted to vary relative to the amplitude of the frequency difference.

A subtle alternative to clock circuit 190 that includes automatic phasing capability is shown schematically in FIG. 18 as an exclusive or-gate or differential rectifier 194 connected to sensor wires 174 and 176. Any such circuit capable of forming a rectified difference between the alternating components of the input signals will yield a pulsed output signal which has a minimum duty cycle at zero phase difference and a maximum when 180 degrees out of phase.

Methods of interfacing of such circuits to enable, disable, or otherwise influence buffer circuit 188 are well-known to those skilled in the electronics art. The appropriate power connections to battery 162 will depend upon the specific components chosen to perform the functions described. The use of split supplies 165 and 166 rather than a battery 162 and other trivial changes are convenient modifications of the same principle.

In the foregoing descriptions, the pacemaker to which the speed of first engine 14 is synchronized has been that of second engine 15. When manual control levers 28 and 30 are nearly parallel, control device 13 causes key 12 to rotate and adjust the coupling length of link 11 by turning threaded tube 74 with respect to threaded collar 72. Throttle arm 34 is thereby moved in either direction with respect to linkage or cable 36, which changes the distance between them. When levers 28 and 30 are moved in unison from one nearly parallel position to another, so as to speed or slow the craft particularly as needed in panic conditions, link 11 slides along key 12, moving arm 34 without the need to render control device 13, 13' or 13" inoperative or to overpower friction drives, or clutches, etc. The speeds are then resynchronized as described before, but to the new speed of the pacemaker or second engine 15. If the engines are to be operated asynchronously, levers 28 and 30 are simply separated beyond the adjustable range of link 11. Collar 72 will then be idled on one of the unthreaded portions 76 of tube 74, again without having to render the device 13, 13' or 13" inoperative or overpower clutches, etc. This ability of apparatus 10 to idle on the no-lube bearing surfaces 76 rather than slip friction clutches, etc. greatly reduces wear.

If apparatus 10 is to be operated manually, the operator adjusts handcrank 170 or electric switch 168 as he either listens for the best frequency between the engines to subside, or observes a synchronization indicator 54 when greater accuracy or phasing is desired. A reduction gearbox 156 containing one or more reduction gears 196 in mesh with a pinion 198 can be added to any control device 13, 13' or 13" as described earlier for more precise position control.

For automatic synchronization where a differential gearbox 110 is directly coupled to key 12 and driven continuously through conduits 44 and 46 from each engine 14 and 15, apparatus 10 is never rendered inoperative or forcibly overridden, but is simply operated sychronously or asynchronously as determined by the position of the control levers 28 and 30 described above. A direct benefit of such unclutched differential gears is that they are excellent monitors of both synchronization and phase when properly geared, so that the operator can manually bump apparatus 10 out of its inherently oscillatory mode and even into a desired phase relation by observing the rotation of shaft 112 and jogging the helm controls 32 periodically. Although the tendency is to return to the oscillatory state, the amplitude and frequency of oscillation can be greatly reduced by using larger reduction gear ratios (slower automatic response times), since the manual response time is undiminished by the apparatus 10.

For automatic synchronization without oscillation, the dead-band properties of electric motor 154 are exploited. Here, motor 154 is coupled either directly or through a reduction gearbox 156 to key 12, and driven by an electric difference generated by monitor 172 relative to the frequency difference between the engines. This type of apparatus 10 operates asynchronously as described before, but stops within a range or dead-band near synchronization rather than constantly oscillating about it. For greater accuracy and maximum response time, a buffer circuit 188 with a high conversion gain (power per rpm difference) is placed between monitor 172 and motor 154 and interrupted periodically by an oscillator or clock 190.

For automatic synchronization with phasing and all of the advantages described above, clock 190 is replaced by a differential rectifier 194.

Each of the aforementioned embodiments of apparatus 10 makes fractional micrometer adjustments in the position of throttle 34 with low friction and zero lash by having threaded tube 74 formed of a no-lubricant bearing material such as nylon, so that anti-lash return-springs, precision bearings, and dirt collecting lubricants can be eliminated. This same principle allows collar 72 to idle freely at ends 76 of a constantly rotating tube 74 in the asynchronous operating mode, and reduces the slip-stick friction when rotation starts or reverses direction. Furthermore, tube 74 slides freely along the length of key 12 to which it is rotatably coupled by the non-cylindrical shape of both keyway 78 and key 12.

Thus, it can be seen that apparatus 10 has advantages in function, economics, and scope of application not found in the prior art and incorporates principles not practiced or desired in prior inventions. It should be understood that the present invention, although primarily designed for use of twin engine craft, can also be used on crafts with one or more engines 14 and that the pacemaker need not be the speed of another engine 15, but may be the speed of craft or any analogous reference. While preferred embodiments of the invention have been disclosed, it should be understood that the spirit and scope of the invention is to be limited solely by the appended claims since numerous modifications of the disclosed embodiments will undoubtedly occur to those of skill in the art.

I claim:

1. Apparatus for synchronizing the speed of an engine to the speed of a pacemaker, the speed of the pacemaker being controlled by pacemaker speed control means, comprising:

an adjustable link;

throttle means for coupling said adjustable link to the engine whose speed is to be synchronized;

a non-cylindrical key rotatably coupled to said adjustable link;

key control means coupled to said key for rotating said key in response to the setting of said pacemaker speed control means; and throttle control means coupled to said adjustable link for manually adjusting said throttle means;

wherein said adjustable link comprises:

a bracket having substantially parallel first and second ends;

a cylindrical tube received between said first and second ends of said bracket and having first and second unthreaded end portions, an intermediate externally threaded portion, and a non-cylindrical internal keyway for matingly receiving said non-cylindrical key;

an internally threaded collar slidable over said unthreaded end portions of said cylindrical tube and rotatably engageable over said threaded portions of said cylindrical tube;

means for pivotably fastening said adjustable link to said throttle means; and means for coupling said throttle control means to said adjustable link.

2. The apparatus of claim 1, wherein the relative movement between said bracket and said collar is linear.

3. The apparatus of claim 2, said bracket comprising a substantially U-shaped member and each of said ends of said bracket having a clearance hole therein for receiving said key.

4. The apparatus of claim 1, said throttle control means comprising:

manual control lever means and a manual control cable having first and second ends, said first end being attached to said adjustable link and said second end being attached to said manual control lever means.

5. The apparatus of claim 4, wherein said first end of said manual control cable is attached to said adjustable link at one of said ends of said bracket.

6. The apparatus of claim 4, wherein said coupling means universally couples said first end of said manual control cable to said end of said bracket.

7. The apparatus of claim 6, said universal coupling means comprising a cable fastener extending perpendicularly from one of said ends of said bracket and a universal block coupled to said cable fastener, said manual control cable being attached to said universal block.

8. The apparatus of claim 4, wherein said pivotable fastening means universally couples said collar to said throttle means.

9. The apparatus of claim 8, said collar having a longitudinal axis and said pivotable fastening means comprising a universal block, a throttle fastener extending from said collar perpendicular to said longitudinal axis of said collar, coupling said universal block to said collar, and bolt means coupling said universal block to said throttle means.

10. The apparatus of claim 4, said bracket further comprising an elongated cylindrical tube have a longitudinal axis, said ends being circular and having clearance holes concentric with said longitudinal axis for receiving said key, and said throttle control means being coupled to said collar.

11. Apparatus for synchronizing the speed of an engine to the speed of a pacemaker, the speed of the pacemaker being controlled by pacemaker speed control means, comprising:

an adjustable link;

throttle means for coupling said adjustable link to the engine whose speed is to be synchronized;

a non-cylindrical key rotatably coupled to said adjustable link;

manual handcrank means coupled to said key for rotating said key in response to the setting of said pacemaker speed control means;

throttle control means coupled to said adjustable link for manually adjusting said throttle means; and a synchronization monitor coupled to said engine and said pacemaker;

wherein said adjustable link comprises:

a bracket having substantially parallel first and second ends;

a cylindrical tube received between said first and second ends of said bracket and having first and second unthreaded end portions, an intermediate externally threaded portion, and a non-cylindrical internal keyway for matingly receiving said non-cylindrical key;

an internally threaded collar slidable over said unthreaded end portions of said cylindrical tube and rotatably engageable over said threaded portion of said cylindrical tube;

means for pivotably fastening said adjustable link to said throttle means; and means for fixedly coupling said throttle control means to said adjustable link.

12. The apparatus of claim 11, said synchronization monitor comprising a differential gear.

13. The apparatus of claim 11, wherein the relative movement between said bracket and said collar is linear, and said bracket comprises a substantially U-shaped member and each of said ends of said bracket have a clearance hole therein for receiving said key.

14. The apparatus of claim 11, said throttle control means comprising:

manual control lever means and a manual control cable having first and second ends, said first end being attached to said adjustable link and said second end being attached to said manual control lever means.

15. The apparatus of claim 14, wherein said first end of said manual control cable is attached to said adjustable link at one of said ends of said bracket.

16. The apparatus of claim 14, wherein said first end of said control cable is universally coupled to said end of said bracket.

17. The apparatus of claim 14, said throttle control means further comprising a cable fastener extending perpendicularly from one of said ends of said bracket and a universal block coupled to said cable fastener, said manual control cable being attached to said universal block.

18. The apparatus of claim 14, wherein said pivotable fastening means universally couples said collar to said throttle means.

19. The apparatus of claim 18, said collar having a longitudinal axis and said pivotable fastening means comprising a universal block, a throttle fastener extending from said collar perpendicular to said longitudinal axis of said collar and coupling said universal block to said collar, and bolt means coupling said universal block to said throttle means.

20. The apparatus of claim 14, said bracket further comprising an elongated cylindrical tube having a longitudinal axis, said ends being circular and having clearance holes concentric with said longitudinal axis for receiving said key, and said throttle control means being coupled to said collar.

21. Apparatus for synchronizing the speed of an engine to the speed of a pacemaker, the speed of the pacemaker being controlled by pacemaker speed control means, comprising:

an adjustable link;

throttle means for coupling said adjustable link to the engine whose speed is to be synchronized;

a non-cylindrical key rotatably coupled to said adjustable link;

differential gear means coupled to said key, said engine, and said pacemaker for rotating said key in response to the setting of said pacemaker speed control means;

throttle control means coupled to said adjustable link for manually adjusting said throttle means; and a synchronization monitor coupled to said differential gear;

wherein said adjustable link comprises:

a bracket having substantially parallel first and second ends;

a cylindrical tube received between said first and second ends of said bracket and having first and second unthreaded end portions, an intermediate externally threaded portion, and a non-cylindrical internal keyway for matingly receiving said non-cylindrical key;

an internally threaded collar slidable over said unthreaded end portions of said cylindrical tube and, rotatably engageable over said threaded portion of said cylindrical tube;

means for pivotably fastening said adjustable link to said throttle means; and means for fixedly coupling said throttle control means to said adjustable link.

22. The apparatus of claim 21, wherein the relative movement between said bracket and said collar is linear.

23. The apparatus of claim 22, said bracket comprising a substantially U-shaped member and each of said ends of said bracket having a clearance hole therein for receiving said key.

24. The apparatus of claim 21, said throttle control means comprising:

manual control lever means and a manual control cable having first and second ends, said first end being attached to said adjustable link and said second end being attached to said manual control lever means.

25. The apparatus of claim 24, wherein said first end of said manual control cable is attached to said adjustable link at one of said ends of said bracket.

26. The apparatus of claim 24, wherein said manual control cable is universally coupled to said end of said bracket.

27. The apparatus of claim 24, said throttle control means comprising a cable fastener extending perpendicularly from one of said ends of said bracket and a universal block coupled to said cable fastener, said manual control cable being attached to said universal block.

28. The apparatus of claim 24, wherein said pivotable fastening means universally couples said collar to said throttle means.

29. The apparatus of claim 28, said collar having a longitudinal axis and said pivotable fastening means comprising a universal block, a throttle fastener extending from said collar perpendicular to said longitudinal axis of said collar and coupling said universal block to said collar, and bolt means coupling said universal block to said throttle means.

30. The apparatus of claim 24, said bracket further comprising an elongated cylindrical tube having a longitudinal axis, said ends being circular and having clearance holes concentric with said longitudinal axis for receiving said key, and said throttle control means being coupled to said collar.

31. The apparatus of claim 1, said key control means comprising:

a reduction gearbox having an output shaft having a first end and a second end, said first end being coupled to said key;

an electric motor coupled to said second end of said output shaft of said reduction gearbox;

a power source electrically connected to said motor; and switch means electrically connected between said motor and said power source for reversing or stopping the current flow through said motor.

32. The apparatus of claim 1, said key control means comprising:

a reduction gearbox having an output shaft having a first end and a second end, said second end being coupled to said key;

an electric motor coupled to said second end of said output shaft of said reduction gearbox, said motor having first and second electrical outlets;

means electrically connected to said first and second electrical outlets for measuring the frequency difference between said first and second electrical outlets; and first and second electrical generators having respective first and second outputs electrically connected to said frequency difference measuring means.

33. The apparatus of claim 32, said key control means further comprising a buffer circuit electrically connected between said first and second electrical outlets of said motor and said frequency difference measuring means.

34. The apparatus of claim 33, said buffer circuit having an inhibit input, and said key control means further comprising an oscillator electrically connected to said inhibit input.

* * * * *